US010443550B2

(12) United States Patent
Zouani et al.

(10) Patent No.: US 10,443,550 B2
(45) Date of Patent: Oct. 15, 2019

(54) INTAKE MANIFOLD WITH IMPRESSIONS FOR IMPROVED NVH PERFORMANCE

(71) Applicant: Ford Global Technologies, LLC, Dearborn, MI (US)

(72) Inventors: Abdelkrim Zouani, Canton, MI (US); Gabriela Dziubinschi, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 121 days.

(21) Appl. No.: 15/250,237

(22) Filed: Aug. 29, 2016

(65) Prior Publication Data

US 2018/0058401 A1 Mar. 1, 2018

(51) Int. Cl.
*F02M 35/12* (2006.01)
*F02M 35/104* (2006.01)

(52) U.S. Cl.
CPC ..... *F02M 35/1277* (2013.01); *F02M 35/104* (2013.01)

(58) Field of Classification Search
CPC ..... F02M 35/1277; F02M 35/104; F02M 35/10321; F02B 77/13; F01N 2260/20
See application file for complete search history.

(56) References Cited

U.S. PATENT DOCUMENTS 8,074,616 B2 * 12/2011 Rolland ..... F02M 35/10144 123/184.21
8,607,756 B1 12/2013 Kulkarni et al.
8,955,485 B2 2/2015 Kulkarni
9,650,989 B2 * 5/2017 Staley ..... F02F 7/008
2008/0168961 A1 * 7/2008 Prior ..... F02M 35/104 123/184.57
2011/0253080 A1 * 10/2011 Newman ..... F02M 35/10321 123/54.4
2014/0165951 A1 * 6/2014 Moetakef ..... F02M 35/10321 123/192.1
2015/0114335 A1 * 4/2015 Yamaguchi ..... F02M 35/10321 123/184.21
2016/0115918 A1 * 4/2016 Kulkarni ..... F02M 35/104 123/590

* cited by examiner

*Primary Examiner* — Joseph J Dallo
*Assistant Examiner* — Kurt Philip Liethen
(74) *Attorney, Agent, or Firm* — LeClairRyan

(57) ABSTRACT

The disclosed inventive concept provides an intake manifold for an internal combustion engine that demonstrates reduced NVH. The disclosed inventive concept provides an intake manifold having intersecting ribs that extend along both the plenum and the intake runners. Impressions or recessed areas are selectively disposed at critical locations between certain ones of the intersecting ribs. Flat areas are formed between each impression and the adjacent ribs. The shapes of the impressions may be polygonal, round or oval or mixture thereof. The thickness of the intake manifold wall may be constant or variable. The location, shape and depth of each of the impressions are selected to thereby optimize both NVH and flow performances. These impressions provide additional localized stiffness that improves high frequency noise without increasing wall thickness, weight, design complexity, or overall cost of tooling, material or manufacture. The disclosed inventive concept reduces intake manifold NVH particularly at higher frequencies.

17 Claims, 6 Drawing Sheets

FIG. 6
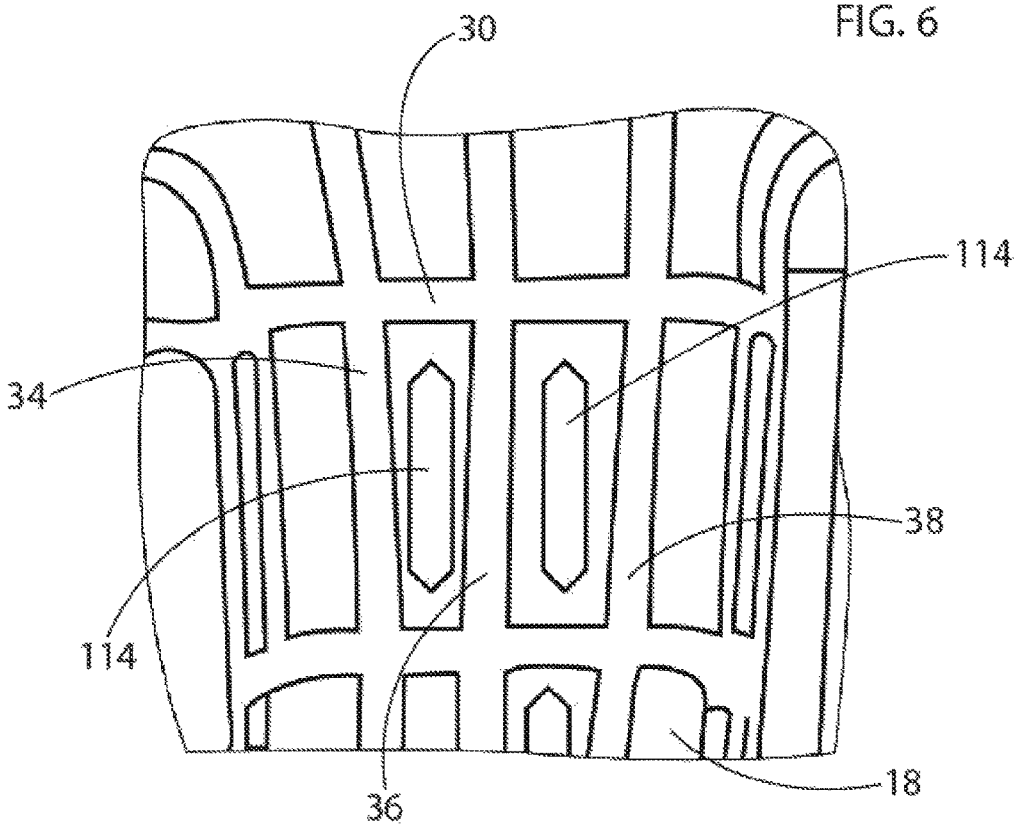
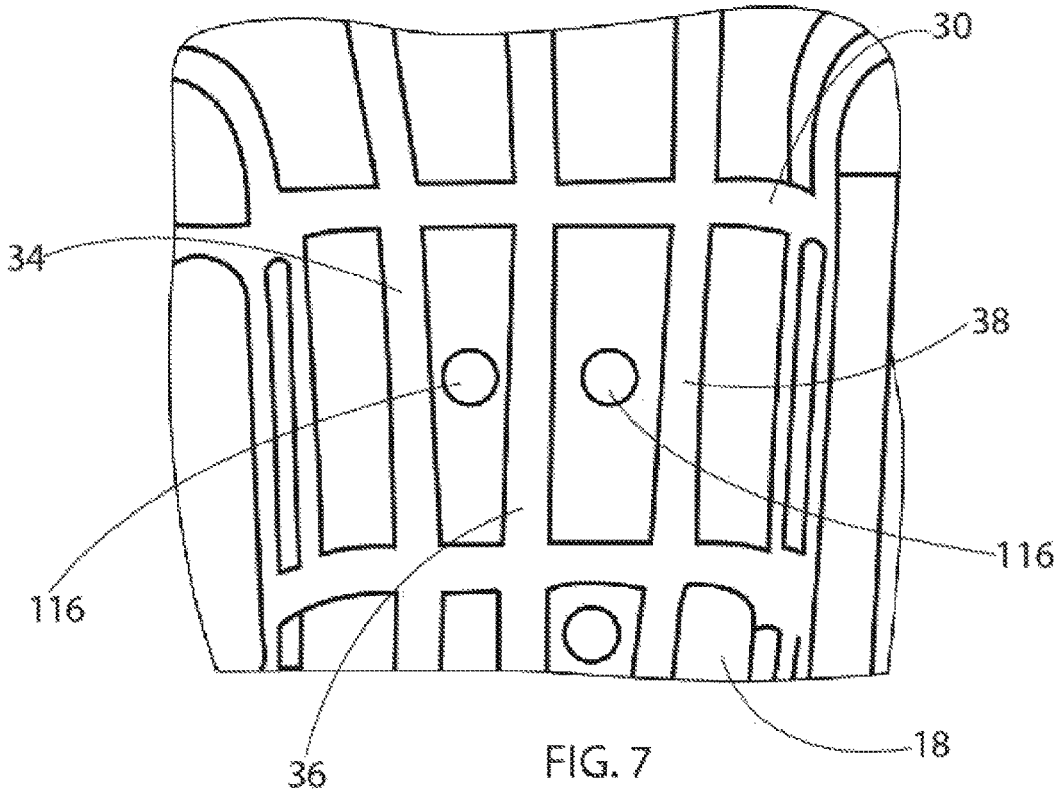
FIG. 7

INTAKE MANIFOLD WITH IMPRESSIONS FOR IMPROVED NVH PERFORMANCE

TECHNICAL FIELD

The disclosed inventive concept relates generally to intake manifolds for internal combustion engines. More particularly, the disclosed inventive concept relates to an intake manifold for an internal combustion engine having external reinforcement ribs on one or both of the plenum and the runners and interspaced impressions or recessed areas formed between the ribs.

BACKGROUND OF THE INVENTION

The internal combustion engine conventionally includes an intake manifold to provide the air or air-fuel mixture to the cylinders. Coupled to the intake end of the intake manifold is a throttle body that controls manifold pressure and air flow to the cylinders. The air enters the intake end of the intake manifold and flows into a plenum. The air exits the plenum and enters the intake ports of the cylinders by way of a plurality of intake runners. In the case of Port Fuel Injection (PFI) engines, the fuel is injected at the intake ports. In the case of Direct Injection (DI) engines, the fuel is directed into the combustion chamber.

While providing necessary functionality, the intake manifold of the internal combustion engine is one of the dominant sources of engine radiated noise. The intake manifold radiates noise, vibration and harshness (NVH) from the surfaces of its plenum and intake runners.

Various designs have been undertaken to reduce NVH created by the intake manifold during engine operation by reducing radiated noise. For example, internal and external bracing has been incorporated to provide a reduction of noise radiating from the manifold's surface and to provide strength, thereby allowing for increased pressure while preventing manifold failure under a backfire condition. To compensate for the reduction of interior space caused by external bracing, the size of the intake manifold has been increased to compensate for the reduction in flow area. However, a larger manifold increases both product cost and weight while also complicating packaging.

Additional efforts to reduce NVH have included increasing the thicknesses of both the plenum and intake runner walls and by adding ribs to one or both of the plenum and the intake runners. Generally, plastic intake manifolds have rib patterns to increase the structural stiffness and reduce the radiated noise.

However, the benefits of such measures are limited by weight and manufacturing and, as a consequence, their inclusion may increase the weight, cost, and complexity in forming the intake manifold beyond acceptable targets. Accordingly, the NVH benefit derived from the use of ribs is limited to a certain frequency range ($f<f_{max}=c/L$, where c is the speed of sound, and L the distance between the ribs).

Accordingly, known approaches to reducing NVH in intake manifolds do not always produce satisfactory results. As in so many areas of vehicle technology, there is always room for improvement related to intake manifold designs having reduced NVH.

SUMMARY OF THE INVENTION

The disclosed inventive concept provides an intake manifold for an internal combustion engine that demonstrates reduced NVH when compared with known intake manifold systems. Particularly, the disclosed inventive concept provides an intake manifold having intersecting ribs that extend along both the plenum and the intake runners.

Impressions or recessed areas are selectively disposed at critical locations between certain ones of the intersecting ribs. Flat areas are formed between each impression and the adjacent ribs. The impressions may be a polygonal, round or oval or mixture thereof. The thickness of the intake manifold wall may be constant or variable.

The location, shape and depth of each of the impressions are selected so as to optimize both NVH and flow performances. These impressions provide additional localized stiffness that improves high frequency noise without increasing wall thickness, weight, design complexity, or overall cost of tooling, material or manufacture. The disclosed inventive concept reduces intake manifold noise in general, and particularly reduces noise at higher frequencies.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein:

FIG. 6 is a top view of a portion of the intake manifold illustrating an impression having a third alternative shape;

FIG. 7 is a top view of a portion of the intake manifold illustrating an impression having a fourth alternative shape.

DETAILED DESCRIPTION OF THE PREFERRED EMBODIMENT

Figure 1:
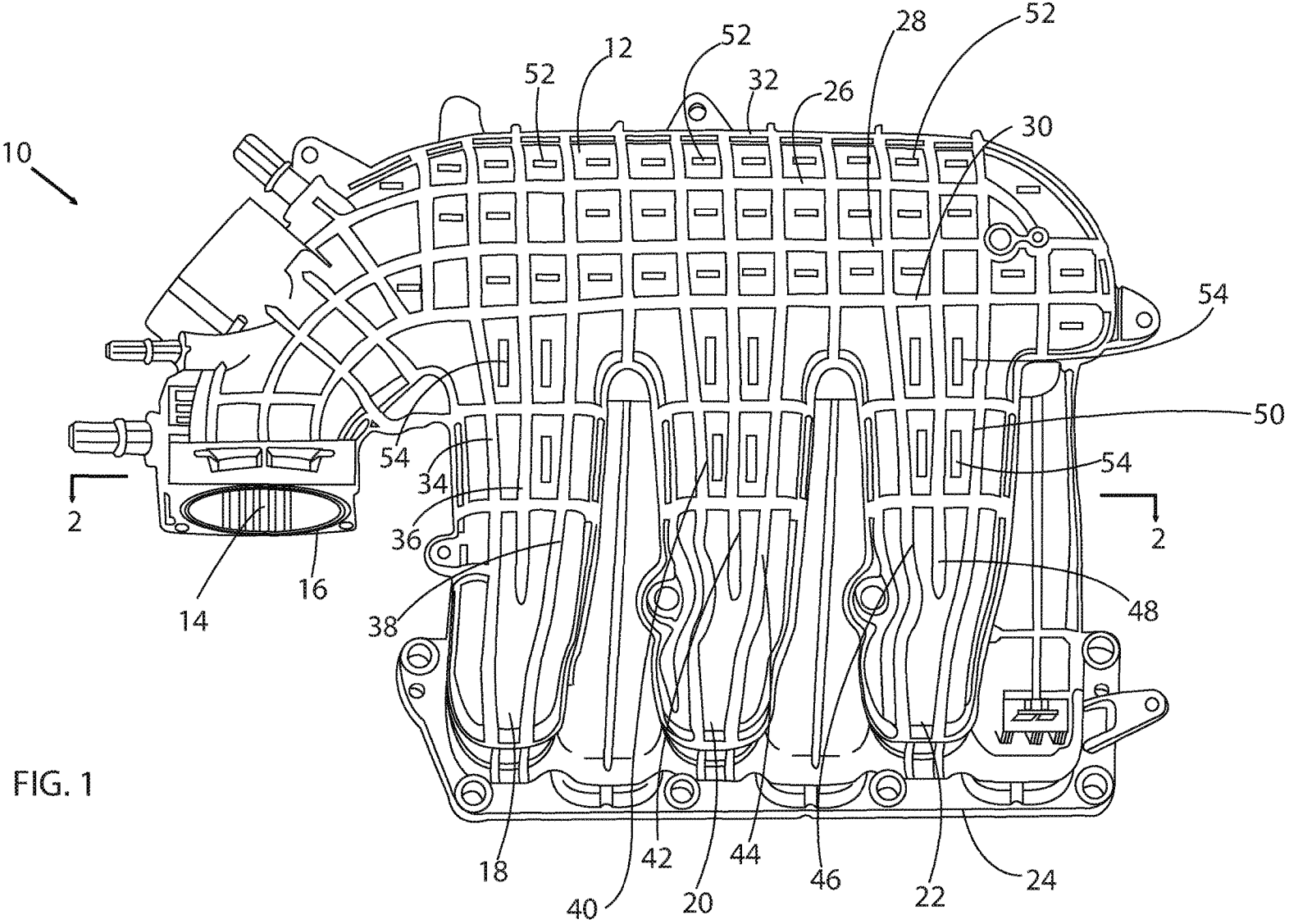
FIG. 1 is a top view of an example intake manifold according to the disclosed inventive concept having impressions formed between certain ones of the ribs on both the outer surface of the plenum as well as on the outer surfaces of the intake runners.

In the following figures, the same reference numerals will be used to refer to the same components. In the following description, various operating parameters and components are described for different constructed embodiments. These specific parameters and components are included as examples and are not meant to be limiting.

Figure 2:
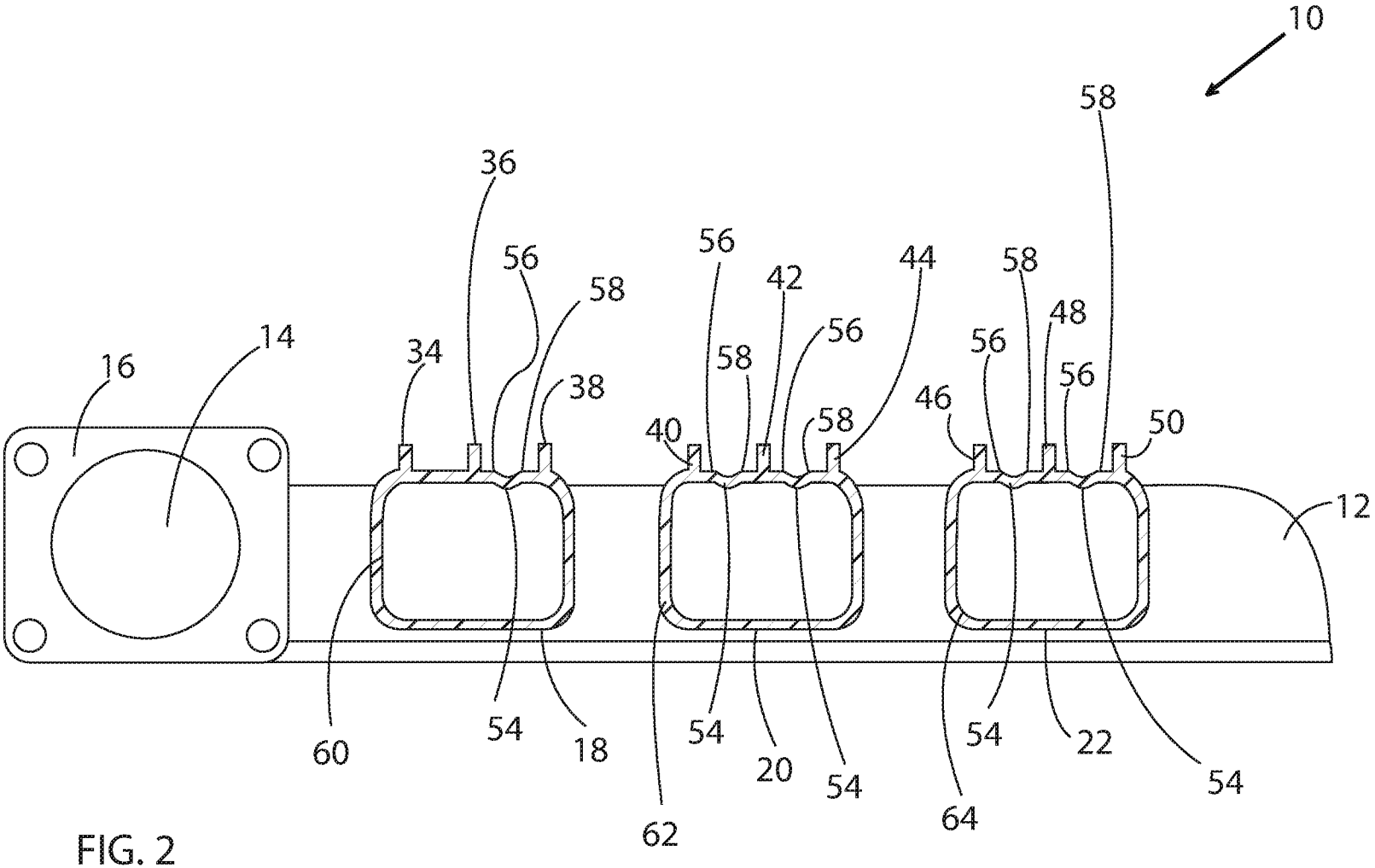
FIG. 2 is a sectional view of the intake manifold illustrated in FIG. 1 and taken along line 2-2 thereof according to one embodiment of the disclosed inventive concept.
Figure 3:
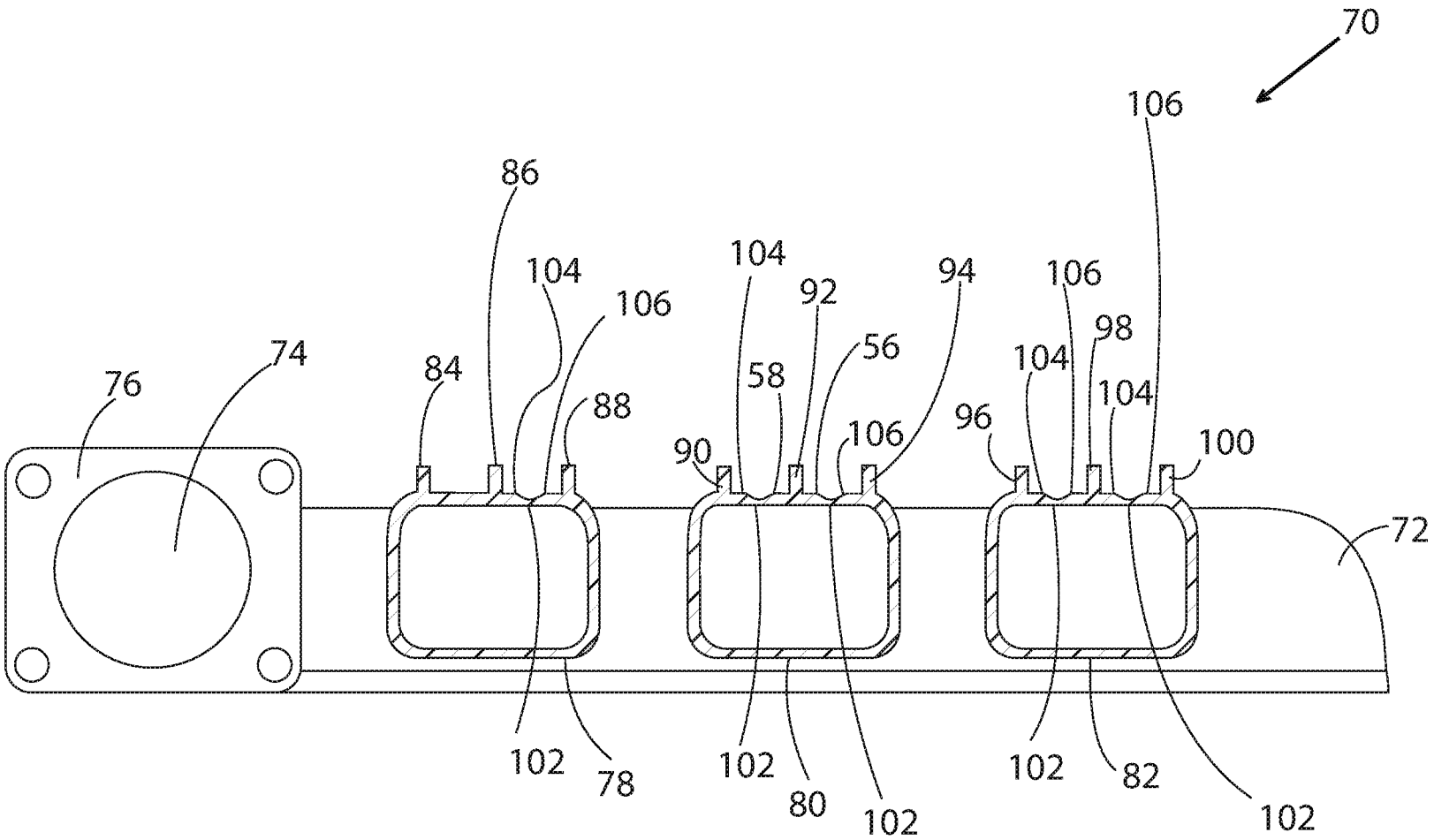
FIG. 3 is a sectional view of the intake manifold illustrated in FIG. 1 and taken along line 2-2 thereof according to another embodiment of the disclosed inventive concept.

The accompanying figures and the associated description illustrate an intake manifold according to the disclosed inventive concept. Particularly, FIG. 1 illustrates an intake manifold according to the disclosed inventive concept, while FIGS. 2 and 3 illustrate two embodiments of the impressions relative to the intake runner wall. FIGS. 4 through 8 illustrate possible non-limiting alternative shapes of the impressions shown in FIG. 1 according to the disclosed inventive concept.

Referring to FIG. 1, a top view of an intake manifold according to the disclosed inventive concept is generally illustrated as 10. It is to be understood that the general shape and size of the intake manifold 10 as illustrated is suggestive and is not intended as being limiting. Alternative configurations could be adopted without deviating from the spirit or scope of the disclosed inventive concept. In addition, while the manifold 10 is illustrated as being an intake manifold, it is to be understood that the disclosed inventive concept may find application as well to other manifolds.

The intake manifold 10 includes a plenum 12. The plenum 12 may be an elongate hollow chamber open at an inlet end that is formed to receive the air from an air inlet 14 formed in an intake face 16. The intake manifold 10 is conventionally configured to distribute the air into a number of individual air flows by way of a corresponding number of runners. As illustrated, and without limitation, the runners of the disclosed inventive concept include a first intake runner 18, a second intake runner 20, and a third intake runner 22. Each of the intake runners 18, 20 and 22 is attached at a first end to the plenum 12 and each at a second end is respectively attached to a corresponding number of combustion chambers at a combustion face 24 which is coupled to a cylinder head (not shown).

Formed on the exterior upper surface of the plenum 12 is a plurality of strengthening ribs that define an intersecting pattern. The pattern is formed by a series of spaced-apart axial ribs that include a first axial rib 26, a second axial rib 28, a third axial rib 30, and an outer axial rib 32. The ribs 26, 28, 30 and 32 may or may not be parallel. It is to be understood that the number and placement of the axial ribs 26, 28, 30 and 32 as shown are suggestive and not intended as being limiting.

Ribs that intersect the axial ribs 26, 28, 30 and 32 are formed on the upper surface of the intake manifold 10 as well. Most of these ribs extend to and onto the intake runners. Particularly, and as illustrated in FIG. 1, a first outer intake runner rib 34, a middle intake runner rib 36, and a second outer intake runner rib 38 are formed on the first intake runner 18. A first outer intake runner rib 40, a middle intake runner rib 42, and a second outer intake runner rib 44 are formed on the second intake runner 20. And a first outer intake runner rib 46, a middle intake runner rib 48, and a second outer intake runner rib 50 are formed on the third intake runner 22. A greater or lesser number of intake runner ribs may be formed on each intake runner. In addition, the number and placement of the ribs may be varied from the number and placement illustrated in FIG. 1.

To provide the most effective reduction of NVH possible, the intake manifold of the inventive concept includes a plurality of impressions or recessed areas strategically formed in either or both of the outer surface of the plenum and on the outer surface of one or more of the intake runners. Accordingly, the impressions can be formed in the outer surface of the plenum, in the outer surface of one or more of the intake runners, or in both of one or more of the intake runners and in the plenum. The placement, size, and shape of the individual impressions can be varied or tuned as needed to produce the most dramatic reduction of intake manifold-generated NVH.

By way of a non-limiting example, a plurality of impressions or recessed areas 52 is provided in the outer surface of the plenum 12. As illustrated in FIG. 1, the impressions 52 are of a rectangular shape and are in general alignment with the long axis of the plenum 12, though this does not have to be the case. Some or all of the impressions 52 may alternatively be disposed perpendicularly to the long axis of the plenum 12. Such position selections are made with the object of fine-tuning of the intake manifold 10 in mind so as to achieve the greatest reduction in NVH.

As an alternative to the impressions 52 placed in the plenum 12 or in addition thereto, a plurality of impressions or recessed areas 54 are formed in one or more of the intake runners. As illustrated in FIG. 1, the impressions 54 are formed on each of the intake runners 18, 20 and 22, though it is not required that the impressions 54 be formed on each runner. In addition, and also as illustrated in FIG. 1, the impressions 54 are also of a rectangular shape and are in general alignment with the long axis of the intake runners 18, 20 and 22, though again this does not have to be the case. Some or all of the impressions 54 may alternatively be disposed perpendicularly to the long axis of each of the intake runners 18, 20 and 22. As with the array of impressions 52 formed in the plenum 12, the number and placement of the impressions 54 on one or more of the intake runners 18, 20 and 22 are choices based on the fine-tuning of the intake manifold 10 in mind.

In addition to varying the number and placement of the impressions 52 on the plenum 12 and the impressions 54 on the intake runners 18, 20 and 22, the depth of the impressions 52 and 54 can also be varied as required for fine-tuning of the NVH-reducing characteristics of the intake manifold 10. The depths of the impressions 52 and 54 need not all be the same and variations are possible and may even be desirable.

Referring to FIG. 2, a sectional view of the intake manifold 10 taken along line 2-2 of FIG. 1 is illustrated. Each of the intake runners 18, 20 and 22 may have substantially rectangular cross-sections (e.g., having parallel sides and a parallel top and bottom), though such geometry may be varied without deviating from the scope or spirit of the disclosed inventive concept. By way of non-limiting example, each of the intake runners 18, 20 and 22 may instead have circular or substantially cylindrical cross-sections including, without limitation, elliptical cross sections.

As noted above and as illustrated in FIG. 1, the impressions are formed between ribs that may or may not be parallel. As illustrated in FIG. 2, the impressions are spaced apart from the ribs, another feature that allows for the designer to fine-tune the construction of the intake manifold so as to provide maximum reduction of NVH. Particularly, each impression 54 is formed between a flat wall 56 to one side and a flat wall 58 to another side. The flat walls 56 and 58 effectively isolate the impression 54 from the adjacent ribs, thus providing additional control to designers as the width of the walls 56 and 58 may be varied and the impression 54 may be formed without incorporating any part of the rib. It is to be understood that while the flat walls 56 and 58 are illustrated as being to each side of the impression 54, the same arrangement is preferably provided for with respect to the impressions 52 formed in the plenum 12.

While the impressions 54 (and 52) provide recessed areas in the intake manifold 10, they do not compromise its structural integrity as the walls of the plenum 12 and the intake runners 18, 20 and 22 remain of a constant thickness. In fact, rather than compromise the structural integrity of the intake manifold 10, the presence of the impressions 54 (and 52) increase the structural integrity of the intake manifold 10. Particularly, the first runner 18 is formed by a wall 60, the second runner 20 is formed by a wall 62, and the third runner 22 is formed by a wall 64. As illustrated in FIG. 2, the thicknesses of each of the walls 60, 62 and 64 is constant according to the embodiment shown therein including in the areas in which the impressions 54 are formed. The same arrangement holds true for the impressions 52 formed in the plenum 12.

In FIG. 2 the walls in which the impressions 54 are formed are of a constant thickness and, as also illustrated, are the same thickness as the other walls of the intake runners 18, 20 and 22. However, this is not necessarily the case as illustrated in FIG. 3. With reference to that figure, an intake manifold 70 according to an alternate embodiment of the disclosed inventive concept is illustrated. The intake manifold 70 includes a plenum 72 having an air inlet 74 formed on an intake face 76. Intake runners 78, 80 and 82 extend from the plenum 72. Like the intake runners 18, 20 and 22, each of the intake runners 78, 80 and 82 may have substantially rectangular cross-sections (e.g., having parallel sides and a parallel top and bottom), though other geometries are possible, such as circular or substantially cylindrical cross-sections including, without limitation, elliptical cross sections.

Ribs 84, 86 and 88 are formed on the intake runner 78. Ribs 90, 92 and 94 are formed on the intake runner 80. Ribs 96, 98 and 100 are formed on the intake runner 82.

The intake manifold 70 includes impressions between the ribs. Particularly, an impression 102 is formed between adjacent ribs such that each impression 102 is formed between a flat wall 104 to one side and a flat wall 106 to another side. As illustrated in FIG. 3, the wall in which each impression 102 is formed is not of constant thickness but is thinnest at the approximate middle of the impression 102. This configuration may be necessary if it is found in operation that the wall in which the impressions 54 of the embodiment of FIG. 2 interfere with airflow because of their intrusion into the inside space of the intake runner.

The rectangular shapes of the impressions 52 and 54 illustrated in FIG. 1 are not the only possible choices. Impressions having other shapes could be utilized in the alternative or in combination with the rectangular shape shown in FIG. 1 Some of these shapes are illustrated in FIGS. 4 through 8.

Figure 4:
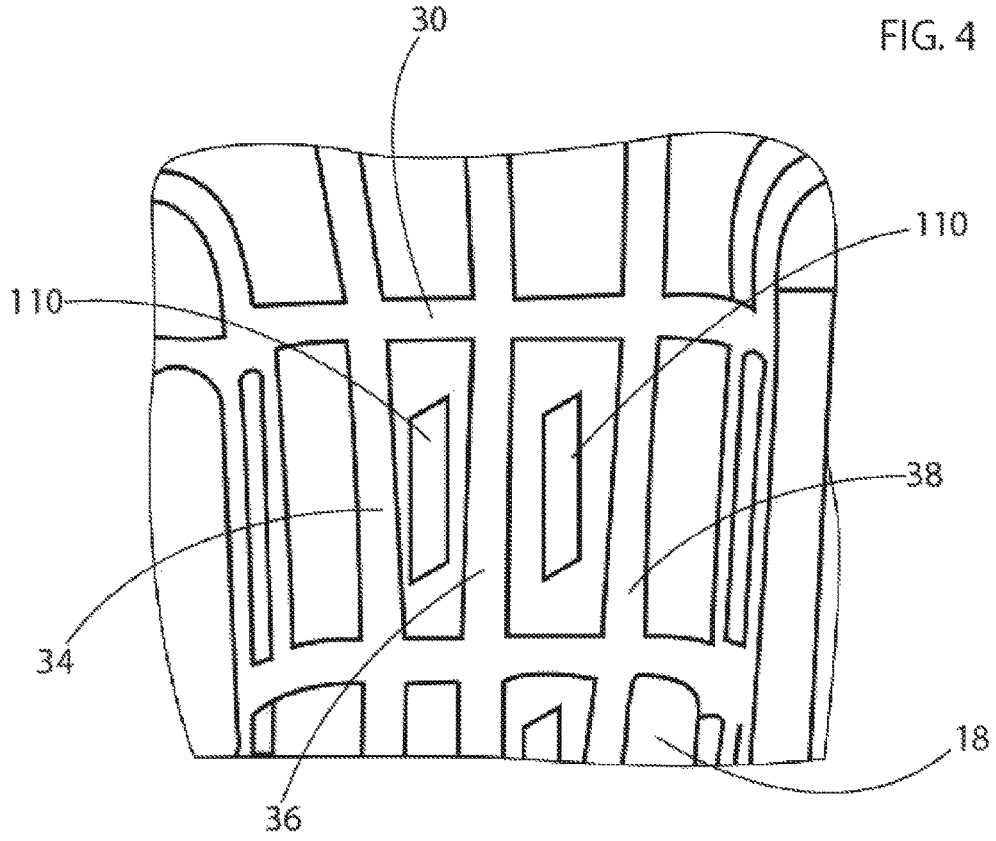
FIG. 4 is a top view of a portion of the intake manifold illustrating an impression having a first alternative shape.
Figure 5:
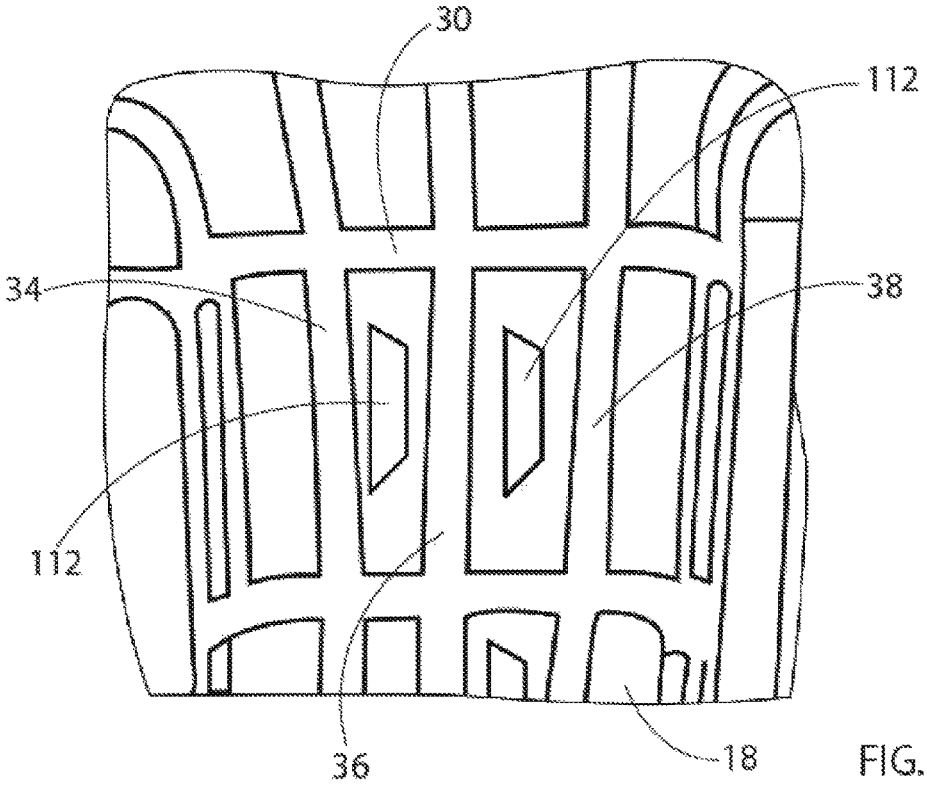
FIG. 5 is a top view of a portion of the intake manifold illustrating an impression having a second alternative shape.
Figure 8:
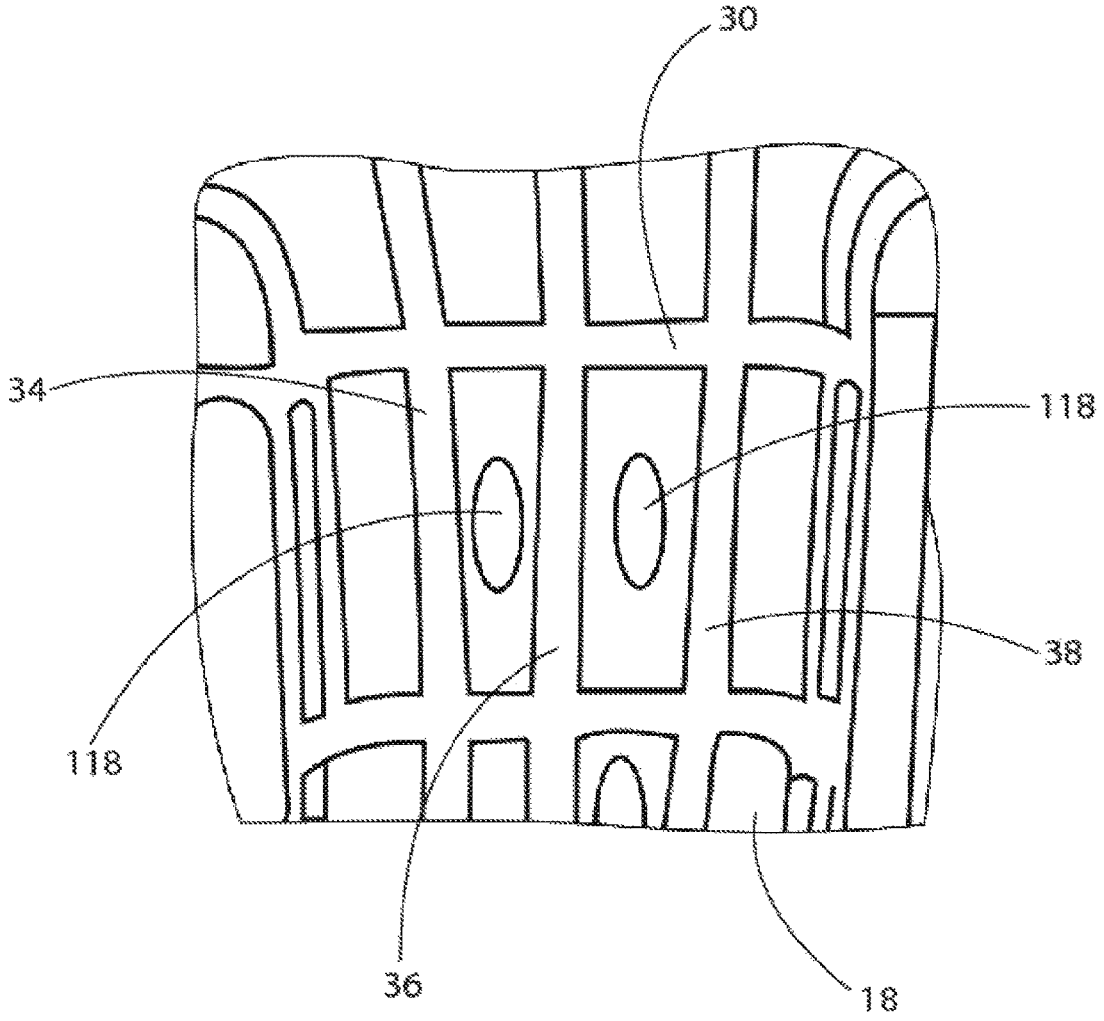
FIG. 8 is a top view of a portion of the intake manifold illustrating an impression having a fifth alternative shape.

Particularly, FIG. 4 is a top view of a portion of the intake manifold 10 having an impression 110 in the shape of a rhombus. FIG. 5 is a top view of a portion of the intake manifold 10 having an impression 112 in the shape of a trapezium. FIG. 6 is a top view of a portion of the intake manifold 10 having an impression 114 in the shape of an elongated hexagon. FIG. 7 is a top view of a portion of the intake manifold 10 having an impression 116 in the shape of a circle. And FIG. 8 is a top view of a portion of the intake manifold 10 having an impression 118 in the shape of an oval. The shapes for impressions illustrated in the accompanying figures are only suggestive as other shapes may be considered.

The number, path, placement, thickness and height of each of the ribs may be modified as required to provide optimum reduction in intake manifold NVH. In addition, the number, shape, placement, path and depth of each of the impressions may also be modified as required. Given these variables, the intake manifold of the disclosed inventive concept provides the engine designer with maximum flexibility and enables specific tuning for a given engine. In this way, NVH associated with the manifold may be reduced without adding weight, cost, or complexity to the manifold. The disclosed inventive concept may be used with any type of engine.

One skilled in the art will readily recognize from such discussion, and from the accompanying drawings and claims that various changes, modifications and variations can be made therein without departing from the true spirit and fair scope of the invention as defined by the following claims.

What is claimed is:

1. An intake manifold having an outer wall, comprising:
a plenum;
at least one intake runner fluidly attached to said plenum;
first ribs extending outwardly from the outer wall and arranged in a first direction on at least one of said plenum and said runner;
second ribs extending outwardly from the outer wall and arranged in a second direction on at least one of said plenum and said runner, said first and second ribs intersecting to form a plurality of enclosed areas; and
a plurality of recessed areas formed in the outer wall and spaced apart from said ribs, each enclosed area of said plurality of enclosed areas including not more than one recessed area of said plurality of recessed areas, each recessed area of said plurality of recessed areas being a concave protuberance,
wherein the outer wall has a thickness, said thickness being continuous in said recessed areas.

2. The intake manifold of claim 1, wherein said first and second ribs are disposed across exterior surfaces of said plenum.

3. The intake manifold of claim 1, wherein said first and second ribs are disposed across exterior surfaces of said intake runner.

4. The intake manifold of claim 1, wherein the outer wall includes flat areas surrounding and isolating said recessed area from said first and second ribs.

5. The intake manifold of claim 1, wherein said recessed areas are centrally located between adjacent ribs of said first and second ribs.

6. The intake manifold of claim 1, wherein said plenum includes a long axis, and wherein at least one of said first ribs is axially aligned with said long axis of said plenum.

7. The intake manifold of claim 1, wherein said intake runner includes a long axis, and wherein at least one of said second ribs is axially aligned with said long axis of said intake runner.

8. The intake manifold of claim 1, wherein each recessed area of said plurality of recessed areas has a shape, said shape being selected from the group consisting of a rectangle, a square, a parallelogram, a trapezium, a circle and an oval.

9. The intake manifold of claim 1, wherein the intake manifold has an interior volume defined by the outer wall, said plurality of recessed areas protrude into the interior volume of the intake manifold.

10. The intake manifold of claim 1, wherein the intake manifold has an interior volume defined by the outer wall, said plurality of recessed areas do not protrude into the interior volume of the intake manifold.

11. An intake manifold having an outer wall, comprising:
a plenum;
at least one intake runner fluidly attached to said plenum;
a plurality of ribs extending outwardly from the outer wall and arranged on at least one of said plenum and said runner in a substantially cross-hatched manner forming a plurality of enclosed areas, each enclosed area having a perimeter; and
a plurality of recessed areas formed in the outer wall, each enclosed area of said plurality of enclosed areas including not more than one centrally located recessed area of said plurality of recessed areas being surrounded by flat surfaces and isolated from said perimeter of enclosed area, wherein the outer wall has a thickness, said thickness being continuous in said recessed areas, wherein the intake manifold has an interior volume defined by the outer wall, each recessed area of said plurality of recessed areas having a concave bottom surface terminating within said interior volume of said intake manifold.

12. The intake manifold of claim 11, wherein said plenum includes a long axis, and wherein at least one of said ribs is axially aligned with said long axis of said plenum.

13. The intake manifold of claim 11, wherein said at least one intake runner includes a long axis, and wherein at least one of said ribs is axially aligned with said long axis of said intake runner.

14. An intake manifold having an outer wall, comprising:

a plenum;

at least one intake runner fluidly attached to said plenum;

a plurality of intersecting ribs extending outwardly from the outer wall and arranged on at least one of said plenum and said runner;

flat surfaces formed between at least one of said intersecting ribs; and a plurality of recessed areas formed in the outer wall, said plurality of recessed areas being isolated from said plurality of intersecting ribs by said flat surfaces and centrally located between adjacent intersecting ribs of said plurality of intersecting ribs, not more than one recessed area formed between adjacent intersecting ribs of said plurality of intersecting ribs, wherein the outer wall has a thickness, said thickness being continuous in each recessed area of said plurality of recessed areas, wherein the intake manifold has an interior volume defined by the outer wall, said plurality of recessed areas does not protrude into the interior volume of the intake manifold.

15. The intake manifold of claim 14, wherein said plenum includes a long axis, and wherein at least one rib of said plurality of intersecting ribs is axially aligned with said long axis of said plenum.

16. The intake manifold of claim 14, wherein said at least one intake runner includes a long axis, and wherein at least one rib of said plurality of intersecting ribs is axially aligned with said long axis of said intake runner.

17. The intake manifold of claim 14, wherein each recessed area of said plurality of recessed areas has a shape, said shape being selected from the group consisting of a rectangle, a square, a parallelogram, a trapezium, a circle and an oval.

* * * * *